US010507664B2

(12) United States Patent
Slomianny

(10) Patent No.: US 10,507,664 B2
(45) Date of Patent: Dec. 17, 2019

(54) LIQUID CARTRIDGE, AND A METHOD FOR FILLING A CARTRIDGE OF THIS TYPE WITH A LIQUID

(71) Applicant: EBS Ink Jet Systeme GmbH, Nümbrecht (DE)

(72) Inventor: Andreas Slomianny, Nümbrecht (DE)

(73) Assignee: EBS INK JET SYSTEME GMBH (DE)

( * ) Notice: Subject to any disclaimer, the term of this patent is extended or adjusted under 35 U.S.C. 154(b) by 0 days.

(21) Appl. No.: 16/093,254

(22) PCT Filed: Apr. 7, 2017

(86) PCT No.: PCT/EP2017/058338
§ 371 (c)(1),
(2) Date: Oct. 12, 2018

(87) PCT Pub. No.: WO2017/178351
PCT Pub. Date: Oct. 19, 2017

(65) Prior Publication Data

US 2019/0176475 A1 Jun. 13, 2019

(30) Foreign Application Priority Data

Apr. 12, 2016 (DE) ..... 10 2016 106 711

(51) Int. Cl.
*B41J 2/175* (2006.01)
*B41J 25/00* (2006.01)
(Continued)

(52) U.S. Cl.
CPC ..... *B41J 2/17506* (2013.01); *B41J 2/17553* (2013.01); *B43L 25/002* (2013.01); *B43L 25/007* (2013.01); *B65D 51/20* (2013.01)

(58) Field of Classification Search
CPC ..... B41J 2/17506; B41J 2/17753; B41J 2/17536; B41J 25/002
See application file for complete search history.

(56) References Cited

U.S. PATENT DOCUMENTS 5,088,995 A 2/1992 Packard et al.
5,494,170 A * 2/1996 Burns ..... B01L 3/50825 215/247

(Continued)

FOREIGN PATENT DOCUMENTS

EP 1064153 B1 8/2003
EP 2796383 A1 10/2014

(Continued)

OTHER PUBLICATIONS

International Search Report for Application No. PCT/EP2017/058338, dated Jul. 13, 2017, 3 pages.

(Continued)

*Primary Examiner* — Jason S Uhlenhake
(74) *Attorney, Agent, or Firm* — McCarter & English, LLP

(57) ABSTRACT

The liquid cartridge for an industrial inkjet printer for printing goods has a film bag, a connector stub connected thereto, and a lower cap. The connector stub has an opening which is closed by the lower cap which has a lower rubber layer, a plastic layer formed by the connector stub, and a lower holder. The lower holder has a lower window which is situated above the opening. The lower holder is fastened to an outer side of the connector stub. The lower rubber layer and, underneath it, the plastic layer are situated below the lower window, and they are in contact with one another and with the lower holder.

13 Claims, 2 Drawing Sheets

(51) Int. Cl.
*B43L 25/00* (2006.01)
*B65D 51/20* (2006.01)

(56) References Cited

U.S. PATENT DOCUMENTS

| | | | | |
|---|---|---|---|---|
| 9,656,786 | B2 * | 5/2017 | Seki | B65D 75/5883 |
| 2016/0200110 | A1 * | 7/2016 | Matsushita | B41J 2/175 347/85 |

FOREIGN PATENT DOCUMENTS

| | | | |
|---|---|---|---|
| JP | 2006341914 | A | 12/2006 |
| JP | 2013107692 | A | 6/2013 |
| WO | 2013120702 | A1 | 8/2013 |

OTHER PUBLICATIONS

Written Opinion for Application No. PCT/EP2017/058338, dated Jul. 12, 2017, 7 pages
International Preliminary Report on Patentability for Application No. PCT/EP2017/058338, dated Jun. 27, 2018, 12 pages.

* cited by examiner

LIQUID CARTRIDGE, AND A METHOD FOR FILLING A CARTRIDGE OF THIS TYPE WITH A LIQUID

CROSS-REFERENCE TO RELATED APPLICATIONS

This application is a national stage application of international application no. PCT/EP2017/058338 filed Apr. 7, 2017, entitled "Liquid Cartridge and a Method for Filling A Cartridge of this Type With a Liquid," claiming benefit under 35 U.S.C. §§ 119(a)-(d) to German application no. DE 10 2016 106 711.3 filed Apr. 12, 2016, which are hereby expressly incorporated by reference as part of the present disclosure.

FIELD OF THE INVENTION

The present disclosure generally relates to a liquid cartridge, for example, an ink cartridge of an industrial inkjet printer for printing goods, and a method for filling such a liquid cartridge. The present disclosure also generally relates to both such inkjet printers in the form of mobile devices, see e.g. WO2013/120702 A1, and in the form of stationary devices, see e.g. EP 1 064 153 B1.

BACKGROUND

Mobile devices are self-contained, such as for example cordless screwdrivers, which are equipped with an internal voltage source, especially an accumulator. With stationary devices, the voltage supply generally is provided from the outside, e.g. via the regular power grid.

The liquid cartridge is also referred to as a storage container. It usually contains ink or a solvent. In general, it contains a liquid required for the printing process. Regarding ink cartridges, reference is made to WO 2013/120702 A1, the disclosure of which is fully incorporated by reference as part of the present disclosure. In practical operation, the reservoir is required to be replaced quite often, as the liquid is constantly used up during printing and the reservoir is depleted after a certain number of printing operations.

According to prior art, the liquid cartridge has a cap comprising a rubber layer, a plastic layer and a holder. The holder overlaps the opening of the cartridge, which is usually formed by a connector stub. The holder is fastened to the connector stub and has a window. The rubber layer and the plastic layer are situated underneath the window, each one overlapping and closing the opening. Such a storage container is filled by first puncturing the layer assembly of the rubber and plastic layers with a hollow needle. The liquid, for example solvent or ink, is then filled into the liquid cartridge, specifically into its film bag, via the hollow needle.

In prior art, it is assumed for the sheet assembly of the rubber layer and plastic layer to automatically re-close the opening or the hole as soon as the hollow needle is withdrawn. However, this does not always apply. The rubber layer material can be used for sealing. The plastic layer supports the rubber layer. The rubber layer has a certain stiffness. The hollow needle tears a hole that does not always completely close when retracting the hollow needle, instead, bending open and mutual overlapping of the hole occasionally occurs, thus preventing sufficiently tight closure. Even if a closure is achieved, it is not permanent. With environmental conditions changing, for example changes in temperature or air pressure, conditions are changing too, which also applies to gassing of the solvents. The pressure within the reservoir can be lower and/or higher than ambient pressure. If it is larger, the punctured area may be pressed open. Droplet discharge or even discharge of a fine stream may then be observed. This becomes of particular importance, if the ink is to be filled in under pressure. It should be possible for overpressurized ink or solvents not to be discharged from the opening site of the layer assembly.

SUMMARY

It is therefore an object to provide safe sealing of the opening following puncturing and filling, so that the filled cartridge loses no ink or solvent during transport, storage, etc. and even after use in an inkjet printer.

This object will be achieved, for example, by storage tanks disclosed herein, and processes disclosed herein.

The plastic layer is an integral component of the connector stub. It seals its opening completely and tightly. It has a thickness that is significantly less than the wall thickness of the connector stub underneath the opening, the thickness of the plastic layer being 5% to 40% of the wall thickness of the connector stub underneath the opening.

By way of the plastic layer, which is made of the same material as the rest of the connector stub, the entity of connector stub and the film bag is tightly sealed. There is no communication with the outside world. It is not before the plastic layer has been punctured, that access to the interior of the connector stub and the film bag is allowed, and there is no access prior to this. A tight and reliable seal is achieved in the area of the opening due to the plastic layer being integral with the rest of the connector stub.

In some embodiments, the plastic layer has the smallest thickness in the central area thereof. Ribs can extend outwards from the edge of this central area, they may be provided on the inner surface and/or on the outer surface of the plastic layer. They additionally reinforce the plastic layer. The rubber layer thus remains soft in the radial direction, but in the axial direction it becomes hard due to the support. A generally soft rubber is used for sealing, as used in rubber bands for disposable glasses or in rubber bands for office applications. The rubber layer is radially positioned and axially clamped by the holder. This applies to both holders.

The windows are provided to allow free access to the layers. The holders can be made of metal. The windows can have the same shape as the opening, but may have smaller dimensions, for example, they are at least one millimeter smaller in diameter than the opening. In some embodiments, the opening thereof is 0 to 20% larger or smaller than the clear opening of the connector stub.

According to one aspect, another cap is provided, it is referred to as the upper cap, it covers the prior art cap, which is now referred to as the lower cap, and closes the opening regardless of whether the lower cap provides effective closure or not. There may be direct contact between at least two or all layers of the two caps. In some embodiments the two rubber layers are in direct contact. Direct contact forces back or prevents mechanical deformation of the lower rubber layer. If the hollow needle has caused damage of the lower rubber layer, and if an edge bulges out of the plane of the first rubber layer, said edge will be pushed back into the plane of the rubber layer by the upper rubber layer when applying the upper cap. Possible leakage of the lower cap is harmless, as in any case a seal will be achieved by the upper cap. In this way, significantly improved sealing of the opening is achieved. This is particularly noticeable when storing and transporting a filled storage container.

According to one aspect, the lower rubber layer is in direct contact with the plastic layer underneath, which is formed by the connector stub itself. In some embodiments, all layers are in planar contact with one another across at least 50% of their surface area. This stabilizes the lower rubber layer. In some embodiments, the holders exert axial pressure onto the respective layer situated underneath them. This results in edge-side sealing above the edge of the opening. At the same time, however, the layers in addition are compressed.

According to one aspect, the upper cap can be slid onto the connector stub. For this purpose, the upper cap has at least one axially extending arm having elasticity, and on which a latching projection is provided. A recess, which is provided on the connector stub and/or the lower cap, cooperates with the latching projection. Latching is such that an axial tension occurs when engaging, i.e. the upper rubber layer is pressed against the lower holder, and is pressed against the lower rubber layer. The upper cap overlaps the assembly of the lower cap and plastic layer.

As a rubber layer, a caoutchouc sheet may be used. As a sheet, a layer having uniform thickness is understood. The thickness of the plastic layer is between 0.05 and 0.3 mm, in some embodiments about 0.1 mm. The thickness of the lower rubber layer is 0.3 to 0.8, or about 0.5 mm. The lower rubber layer is at least 10% thicker than the upper rubber layer, and may be about twice as thick. The lower rubber layer may be 1.5 to 2.5 times thicker than the upper sheet, i.e. outer rubber layer.

Generally, the cartridge may be a cartridge with any filling, as long as it is a liquid, which is required for printing in an industrial inkjet printer for printing goods.

In the process of filling a liquid cartridge for an inkjet printer for printing goods, the liquid cartridge may comprise a bottle, in which the film bag is situated. The interior space, which is to be filled with the liquid, is confined by the film bag and the connector stub. The plastic layer of the connector stub is still undamaged, and completely seals the opening of the connector stub. The lower rubber layer is punctured first and then the plastic layer is punctured with a hollow needle to gain access to the interior. Liquid can now be introduced into the interior through the hollow needle. This may be done under pressure. Any air volume present in the interior can escape through leaks between the hollow needle and the lower rubber layer; the hollow needle has an additional venting channel, if required. Once the interior is filled with the liquid, for example ink, the hollow needle can be pulled out again. It is achieved by the plastic layer that the surfaces of the rubber layer are maintained and no part of the rubber layer can move outwards at the puncture point.

In order to be able to even better protect the condition thus achieved, in another aspect, an upper cap is provided, which comprises an upper rubber layer and an upper holder. Said upper holder comprises an upper window. Said upper cap is now applied to the lower cap, it is fastened to the connector stub and/or the lower cap. It covers the lower cap with its upper rubber layer. For example, the upper rubber layer tightly abuts against the holder, thus sealing the lower window to the outside. Even if the lower rubber layer is or becomes leaky, the upper rubber layer becomes a complete seal.

BRIEF DESCRIPTION OF DRAWINGS

Further features and advantages can be ascertained from the claims and in the following description of non limiting working examples, which will be explained in greater detail hereafter, with reference to the drawings, wherein:

DETAILED DESCRIPTION OF EMBODIMENTS

Figure 1:
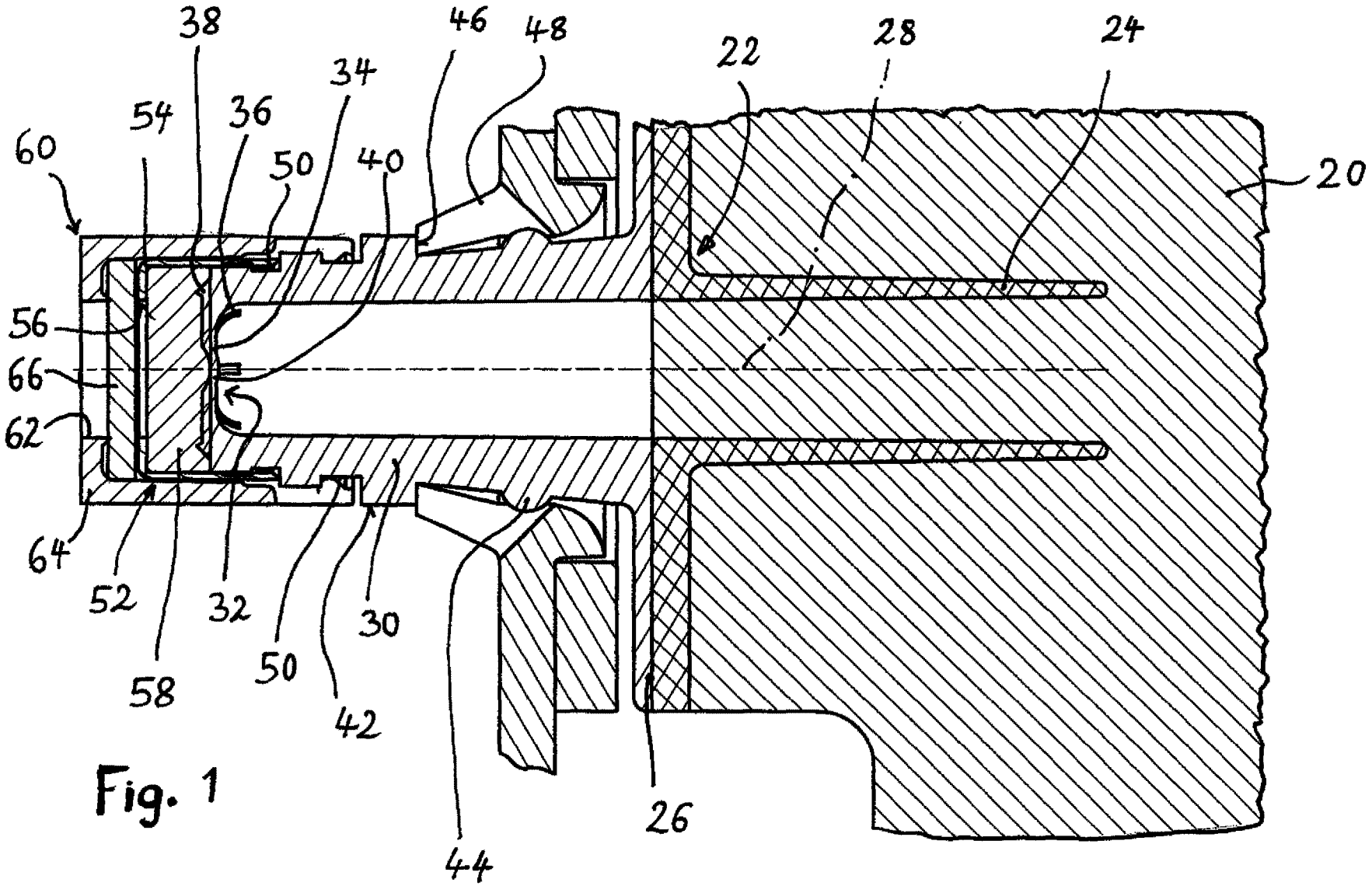
FIG. 1 shows a sectional view of a liquid cartridge in an axial plane through a liquid cartridge.

The liquid cartridge has a film bag 20 and a connector stub 22 tightly connected thereto. The film bag 20 has an edge, the edge being circumferentially tightly connected to the connector stub, for example welded. Usually, both parts are made of plastic. In some embodiments, the connector stub 22 is made of PE (polyethylene). The film bag 20 can also be made of PE. The connector stub 22 comprises an inner channel. The connector stub 22 comprises an inner pipe 24, which projects into the film bag 20. Moreover, it comprises a collar 26 which extends radially, transversally to an axial direction 28, and is disc-shaped. On the other side of the collar 26, a nozzle 30 is formed, which projects out of the film bag 20 and also extends in axial direction 28. The inner channel passes through the inner tube 24, the collar 26 and the socket 30, through which the interior of the film bag 20 is connected to the outside world.

The front end of the nozzle 30 forms an opening 32, said opening being completely closed by a plastic layer 34. The plastic layer 34 is an integral part of the connector stub 22, and is installed simultaneously during manufacture thereof. The connector stub 22 is manufactured, for example, by injection molding.

The plastic layer 34 comprises inner ribs 36 and outer ribs 38, which are integrally connected to the plastic layer 34 and extend radially outwards. Said ribs do not extend to the center, there is rather a central area 40 in the center. The ribs 36, 38 do not extend into said central area. It is the center area 40 which may be hit later during puncturing.

An outer side 42 of the connector stub 22 is structured with several protrusions and indentations, which will be referred to in the following two paragraphs:

A bead 44 is situated near the collar 26 and outside this bead 44 a stop surface 46 is situated. A counterpart 48 abuts against the stop surface, which counterpart additionally is supported by the bead 44. This counterpart 48 does not belong to the liquid cartridge or storage container, but to a printer. It is shown how the liquid cartridge can be mounted, for example, in a printer, which is not shown in detail herein.

Two circumferential locking grooves 50 are situated outside the stop surface 46 on the outer side 42 of the connector stub 22, the purpose of which will now be described: A lower cap 52 is placed on top of the opening 32, specifically it is axially pushed thereon and is fastened to the stub 22 in the outer locking groove 50 by latching. The lower cap 52 has a metal lower holder 54 which is formed similar to a pot. A large hole is provided in the bottom of the pot, this hole is a lower window 56. As viewed from the lower window 56, the lower holder 54 axially and also radially abuts on a lower rubber layer 58. The lower holder 54 comprises arms extending in axial direction, which extend towards the collar 26. They are spring-elastic and comprise barbs that engage in the outer locking groove 50. The lower rubber layer 58 is clamped in an axial direction, is positioned in a radial direction and is not pressurized as in an axial direction. The lower window 56 has an approximate diameter which corresponds to the inner diameter of the inner channel.

As it is shown in the embodiment illustrated in FIG. 1, the lower rubber layer 58 is a cylinder or a flat disc.

An upper cap 60 is axially fastened to the lower holder 54. It also comprises a window, and comprises an upper window 62, which is essentially of the same size as the lower window 56 and is flush thereto. The upper cap 60 comprises an upper holder 64, which is formed similar to the lower holder 54 Similar to said lower holder, it laterally overlaps a rubber layer, herein the upper rubber layer 66, and also overlaps it radially, i.e. in a circumferential direction. In this way, the upper rubber layer 66 will also become axially compressed, and will be fixed in a radial direction. It is pressed against the axial outer surface of the lower holder 54, so that a seal will be achieved thereon. The upper holder 56 also is essentially pot-shaped, having axially protruding, resilient arms, which also have snap-in devices so that they can engage in the inner locking groove 50 as shown in the Figure. The lower cap 52 is almost completely covered. As it is shown in the embodiment illustrated in FIG. 1, the upper rubber layer 66 is a cylinder or a flat disc. It is less than half as thick as the lower rubber layer 58.

The liquid cartridge of an industrial inkjet printer for printing goods comprises a film bag 20, a connector stub 22 and a lower cap 52. The connector stub 22 comprises an opening 32, the opening 32 is closed by the lower cap 52, which has a lower rubber layer 58, a plastic layer 34 formed by the connector stub 22 and a lower holder 54. The lower holder 54 has a lower window 56 situated above the opening 32. The lower holder 54 is fastened to an outer side 42 of the connector stub. The lower rubber layer 58 and the plastic layer 34 below it are situated beneath the lower window 56, and they are in contact with one another and with the lower holder 54.

The bottom may be viewed axially towards the interior of the liquid cartridge, i.e. in the figures, in axial direction 28 to the right, and the top or the front may be viewed to the left in the figures.

Figure 2:
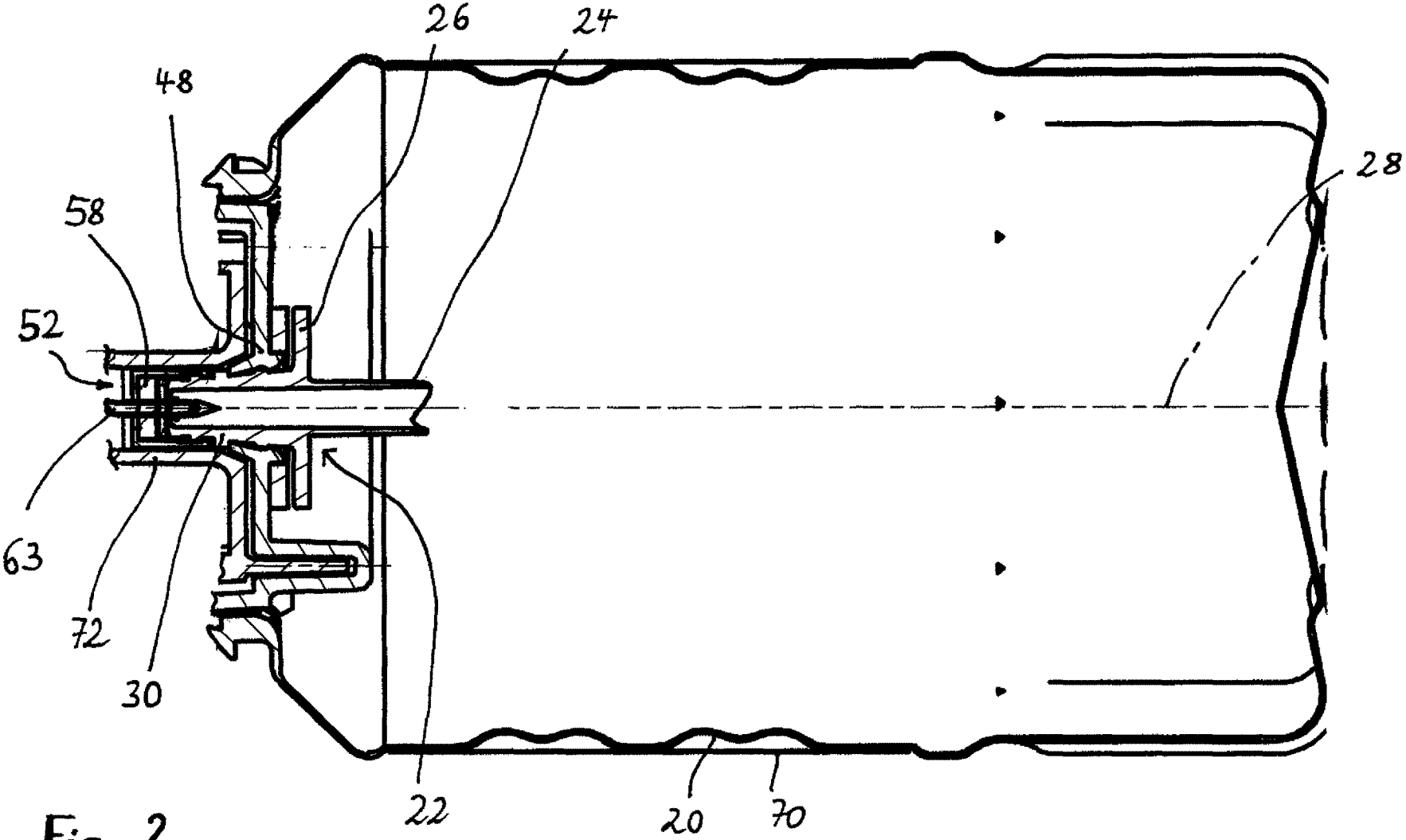
FIG. 2 shows a sectional view in an axial plane of a liquid cartridge similar to the liquid cartridge illustrated in FIG. 1 with a bottle and inserted into an inkjet printer.

FIG. 2 shows a bottle 70 of the liquid cartridge, in the bottle 70 the film bag 20 is situated. The printer comprises an accommodation 72 containing the front part of the connector 30 and the two caps 52, 60. In the embodiment of FIG. 2, only one lower cap 52 is provided. In FIG. 2, a hollow needle 63 is shown, which has been punctured through the lower rubber layer 58 and through the plastic layer 34 with its tip in the inner channel. Liquid can now be withdrawn from the storage bottle through the hollow needle 63. What is shown is the state of a liquid cartridge that is inserted into an inkjet printer that otherwise is not shown in detail.

Terms such as essentially, significantly and the like should be understood to mean that a deviation of plus/minus 5%, plus/minus 2% and plus/minus one percent from the normal value is allowed.

The liquid cartridge for an industrial inkjet printer for printing goods has a film bag 20, a connector stub 22 and a lower cap 52. The connector stub 22 comprises an opening 32, the opening 32 is closed by the lower cap 52, which has a lower rubber layer 58, a plastic layer 34 formed by the connector stub 22 and a lower holder 54. The lower holder 54 has a lower window 56 situated above the opening 32. The lower holder 54 is fastened to an outer side 42 of the connector stub. The lower rubber layer 58 and the plastic layer 34 below it are situated beneath the lower window 56, and they are in contact with one another and with the lower holder 54.

What is claimed is:

1. A liquid cartridge for an industrial inkjet printer for printing goods, wherein the liquid cartridge comprises a film bag, a connector stub connected thereto, and a lower cap, wherein the connector stub has an opening closed by the lower cap comprising a lower rubber layer, a plastic layer defined by the connector stub and a lower holder, wherein the lower holder comprises a lower window located above the opening and is fastened to an outer side of the connector stub, wherein the lower rubber layer and the plastic layer, which is located below the lower rubber layer, are located below the lower window, such that they are in contact with one another and with the lower holder, and wherein the liquid cartridge further comprises an upper cap further closing the opening, the upper cap comprising an upper rubber layer and an upper holder, wherein the upper holder overlaps the lower holder and has an upper window located in front of the opening, and the upper holder is fastened to one or more of the lower holder or to the outer side of the connector stub.

2. The liquid cartridge according to claim 1, wherein the distance between the rubber layers is less than 1 mm, or the rubber layers are in contact with one another.

3. The liquid cartridge according to claim 1, further comprising a bottle in which the film bag is located, and from which the connector stub at least partially extends outward.

4. The liquid cartridge according to claim 3, wherein the bottle comprises a plastic bottle.

5. The liquid cartridge according to claim 1, wherein the lower rubber layer is at least 1.5 times as thick as the upper rubber layer.

6. The liquid cartridge according to claim 5, wherein the lower rubber layer is at least 2 times as thick as the upper rubber layer.

7. The liquid cartridge according to claim 1, wherein the plastic layer is no more than half of the thickness of the lower rubber layer.

8. The liquid cartridge according to claim 7, wherein the plastic layer is no more than ¼ of the thickness of the lower rubber layer.

9. The liquid cartridge according to claim 1, wherein the upper cap comprises multiple arms, extending transversally to the upper window, the arms comprising projections, and wherein one or more of the connector stub or the lower holder comprise locking bulges, which engage the projections.

10. The liquid cartridge according to claim 1, wherein the plastic layer is integral with the connector stub.

11. The liquid cartridge according to claim 1, further comprising ribs located on one or more of an outside or on an inside of the plastic layer.

12. A method for filling a liquid cartridge for an inkjet printer for printing goods, wherein the liquid cartridge comprises a film bag and a connector stub connected thereto, the connector stub having an opening which is sealed off by a lower cap comprising a plastic layer formed by the connector stub, a lower rubber layer, and a lower holder, wherein the lower cap has a lower window located above the opening, the lower cap is fastened to the connector stub, the lower rubber layer is located between the lower holder and, and also in contact with, the opening, and the plastic layer is located below the lower rubber layer, the method comprising the following steps:

Puncturing the lower rubber layer and the plastic layer with a hollow needle, filling liquid, through the hollow needle into an interior of the film bag, applying an upper cap onto the lower cap, wherein the upper cap comprises an upper rubber layer and an upper holder having an upper window, and fastening the upper cap to one or more of the connector stub or the lower cap.

13. A method according to claim 12, wherein the filling liquid is ink.

* * * * *